US009493018B2

(12) United States Patent
Nishikawa

(10) Patent No.: US 9,493,018 B2
(45) Date of Patent: Nov. 15, 2016

(54) PRINTING APPARATUS WITH CUT UNIT CONFIGURED TO CUT A SHEET ACCORDING TO AN OPERATOR'S INSTRUCTIONS

(75) Inventor: Fumikazu Nishikawa, Zushi (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 13/552,432

(22) Filed: Jul. 18, 2012

(65) Prior Publication Data

US 2013/0022383 A1 Jan. 24, 2013

(30) Foreign Application Priority Data

Jul. 22, 2011 (JP) ..... 2011-160911

(51) Int. Cl.

| | |
|---|---|
| ***B41J 11/70*** | (2006.01) |
| ***B41J 29/38*** | (2006.01) |
| ***B41J 15/04*** | (2006.01) |
| ***B41J 11/66*** | (2006.01) |
| ***B65H 19/10*** | (2006.01) |
| ***B65H 16/00*** | (2006.01) |
| ***B26D 1/04*** | (2006.01) |
| ***B26D 5/32*** | (2006.01) |

(52) U.S. Cl.

CPC ..... *B41J 11/663* (2013.01); *B26D 1/045* (2013.01); *B26D 5/32* (2013.01); *B41J 11/70* (2013.01); *B41J 15/04* (2013.01); *B65H 16/005* (2013.01); *B65H 19/105* (2013.01); *B65H 2301/122* (2013.01); *B65H 2511/11* (2013.01)

(58) Field of Classification Search

CPC ..... B41J 29/38; B41J 11/70; B41J 11/42; B41J 11/66; B41J 11/663; B65H 19/105

USPC ..... 400/621, 611, 614

See application file for complete search history.

(56) References Cited

U.S. PATENT DOCUMENTS

| | | | | |
|---|---|---|---|---|
| 5,257,567 | A * | 11/1993 | Walker | B26D 1/565 399/385 |
| 6,296,406 | B1 * | 10/2001 | Kurashina | 400/615.2 |
| 2004/0163511 | A1 * | 8/2004 | Shinga | 83/13 |
| 2008/0304895 | A1 * | 12/2008 | Masuda et al. | 400/621 |

FOREIGN PATENT DOCUMENTS

| | | | |
|---|---|---|---|
| JP | H03-105358 | A | 5/1991 |
| JP | H04-220368 | A | 8/1992 |
| JP | 06215215 | A * | 8/1994 |
| JP | H07-266622 | A | 10/1995 |

(Continued)

OTHER PUBLICATIONS

RD 457198, Simple print registration for continuous forms printers, International Business Machines Corporation, May 2002.*

*Primary Examiner* — Daniel J Colilla

(74) *Attorney, Agent, or Firm* — Canon U.S.A., Inc. IP Division

(57) ABSTRACT

A printing apparatus configured to perform printing on a sheet that is wound in a roll shape, the printing apparatus including: a feeding unit configured to feed a sheet that is drawn out of a roll sheet of a loaded sheet; a cut unit configured to cut the sheet fed by the feeding unit; and an operation unit configured to operate the feeding unit and the cut unit to function. The operation unit can operate the feeding unit and the cut unit to convey the sheet by an arbitrary amount and cut before the sheet is first printed.

15 Claims, 12 Drawing Sheets

(56) References Cited

FOREIGN PATENT DOCUMENTS

| | | | | | |
|---|---|---|---|---|---|
| JP | 08132388 | A | * | 5/1996 | ..... B26D 5/30 |
| JP | H10-006605 | A | | 1/1998 | |
| JP | 2001-180055 | A | | 7/2001 | |
| JP | 2003246108 | A | * | 9/2003 | |
| JP | 2003337447 | A | * | 11/2003 | ..... G03G 15/00 |
| JP | 2005-250201 | A | | 9/2005 | |
| JP | 2006192863 | A | * | 7/2006 | |
| JP | 2009190245 | A | | 8/2009 | |
| JP | 2011110806 | A | * | 6/2011 | ..... B41J 29/42 |

* cited by examiner

PRINTING APPARATUS WITH CUT UNIT CONFIGURED TO CUT A SHEET ACCORDING TO AN OPERATOR'S INSTRUCTIONS

BACKGROUND OF THE INVENTION

Field of the Invention

The present invention relates to a printing apparatus, and more particular to a printing apparatus which performs printing on a roll sheet.

Description of the Related Art

Conventionally, a printing apparatus that performs printing on a roll sheet performs a sheet feeding operation when a roll sheet is loaded into a roll sheet loading unit of the printing apparatus. The sheet feeding operation includes conveying a leading edge of the roll sheet through a conveyance path of the printing apparatus up to a print start position. The printing apparatus then prints a print job input from an external apparatus such as a connected host personal computer.

Roll sheets for such a printing apparatus to use for printing are often stored with their leading edge portions exposed and, sometimes, stained. In addition, an operator who loads a roll sheet may touch the leading edge portion of the roll sheet with his or her hand and stain the leading edge with a scratch or fingerprints. Printing on stained paper has the problem of reduced print quality. Printing can be started at an unstained portion by feeding a roll sheet up to an unstained position before the input of a print job. If, however, a print job is input before a sheet feeding operation on a roll sheet, printing will be started immediately after the completion of the sheet feeding operation. This results in printing on a stained portion.

Japanese Patent Application Laid-Open No. 2001-180055 discusses a technique in which a printing apparatus cuts a leading edge portion of a roll sheet when the roll sheet is loaded. A leading edge portion of a roll sheet can be cut to avoid printing on a stained leading edge portion of the roll sheet if any. Since printing can be started at a cut unstained portion, a reduction in print quality can be prevented.

The printing apparatus discussed in Japanese Patent Application Laid-Open No. 2001-180055, however, has the following problem. When a roll sheet is loaded, a leading edge of the roll sheet is always cut off by a predetermined length regardless of whether the leading edge of the roll sheet is stained. Consequently, paper can be wasted despite operator's intentions if the roll sheet is not stained.

SUMMARY OF THE INVENTION

The present invention is directed to allowing an operator to determine whether to use a leading edge of a roll sheet for printing, and to select the length of a unused portion for printing if any. The present invention is directed to providing a printing apparatus which can thus handle a roll sheet in an optimal way according to the state of the leading edge of the roll sheet.

According to an aspect of the present invention, a printing apparatus includes: a support unit configured to support a roll sheet; and a cut unit configured to cut a sheet drawn out of the roll sheet supported by the support unit, the cut unit is configured, when the roll sheet is loaded into the support unit and before the sheet is printed, to cut the sheet drawn from the support unit in a position according to an operator's instruction.

According to the present invention, a leading edge of a roll sheet can be cut off by an arbitrary length when the roll sheet is loaded into the printing apparatus. This can reduce useless consumption of the roll sheet and suppress a reduction in the quality of a print product.

Further features and aspects of the present invention will become apparent from the following detailed description of exemplary embodiments with reference to the attached drawings.

BRIEF DESCRIPTION OF THE DRAWINGS

The accompanying drawings, which are incorporated in and constitute a part of the specification, illustrate exemplary embodiments, features, and aspects of the invention and, together with the description, serve to explain the principles of the invention.

DESCRIPTION OF THE EMBODIMENTS

Various exemplary embodiments, features, and aspects of the invention will be described in detail below with reference to the drawings.

Figure 1A:
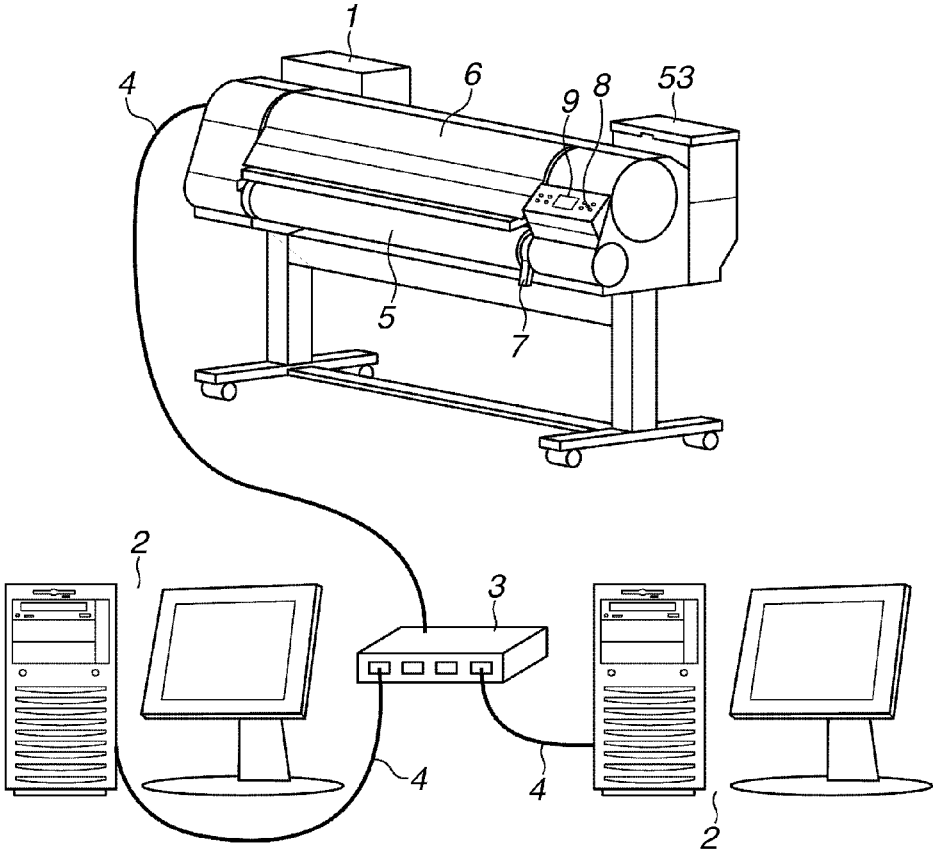
FIGS. 1A and 1B are diagrams illustrating the configuration of a printing apparatus according to an exemplary embodiment of the present invention.

A first exemplary embodiment will be described. FIG. 1A is a diagram illustrating a printing apparatus according to the first exemplary embodiment of the present invention. In the diagram, the printing apparatus 1 performs printing on a print sheet based on information input from outside and/or information previously stored inside. A plurality of host computers (hereinafter, referred to as hosts) 2 are connected to the printing apparatus 1 through a network hub 3 and network cables 4. The hosts 2 transfer print data and information for controlling the printing apparatus 1 (hereinafter, referred to as a print job) to the printing apparatus 1. A roll sheet 5 is a continuous long sheet (recording medium) that is wound in a roll shape. The loaded roll sheet 5 is rotatably supported by a support unit. A main cover 6 is opened when feeding a roll sheet 5 and when replacing a print head and/or a cutter unit to be described later. FIG. 1A illustrates the printing apparatus 1 with the main cover 6 closed.

A release lever 7 is a lever for pressing a roller to be described later against a platen to fix a roll sheet 5, and releasing the roller from the platen to allow insertion of a roll sheet 5. FIG. 1A illustrates the printing apparatus 1 with the release lever 7 closed. Operation keys 8 are members to make various settings as to the operation of the printing apparatus 1 and to operate when using the printing apparatus 1 by itself. A display panel 9 displays the status of the printing apparatus 1 and displays setting contents when making operation settings of the printing apparatus 1 from the operation keys 8 serving as an operation unit. The type of paper to print and the printing image quality can also be set by the operation keys 8 and the display panel 9. An ink tank cover 53 is opened to load and replace ink tanks to be described later.

Figure 1B:
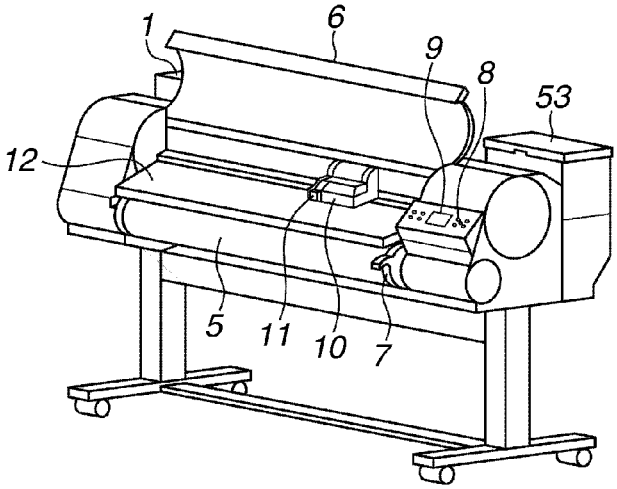

FIG. 1B illustrates the printing apparatus 1 with the main cover 6 opened and the release lever 7 released. A carriage 10 and a cutter unit 11 are arranged inside the main cover 6. The cutter unit 11 is a cut unit integrated with the carriage 10. The carriage 10 and the cutter unit 11 are driven in a horizontal direction to perform printing and paper cutting. Paper is conveyed over a platen 12 in front and back directions.

Figure 2:
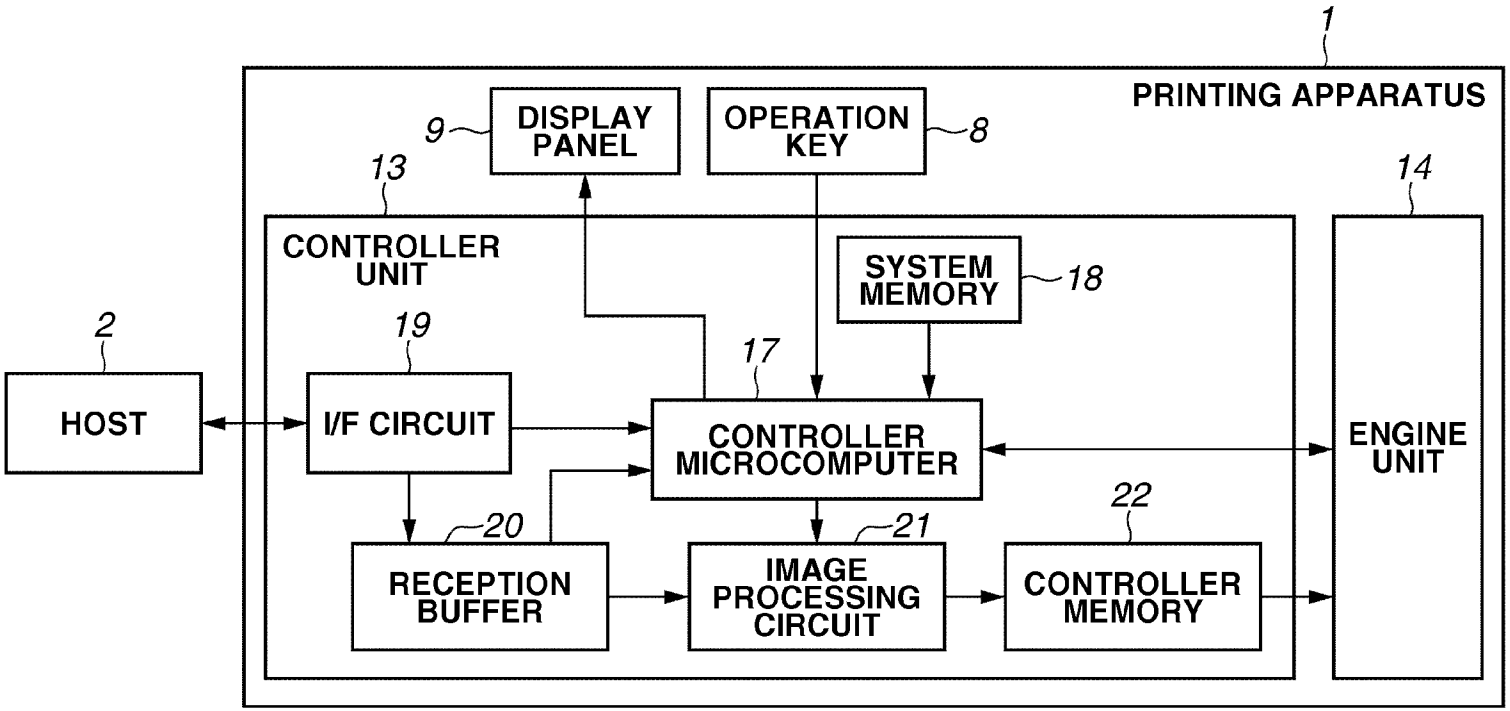
FIG. 2 is a diagram illustrating an overview of the configuration of the printing apparatus according to the exemplary embodiment of the present invention.

FIG. 2 is a diagram illustrating an overview of the configuration of the printing apparatus 1. In the diagram, the printing apparatus 1 includes a controller unit 13 and an engine unit 14. The controller unit 13 inputs a print job from a host 2, and performs processing such as analysis of the print job to generate print data in a format printable in the engine unit 14. The controller unit 13 receives inputs from the operation keys 8 and makes settings as to the operating environment of the printing apparatus 1. The controller unit 13 also makes the display panel 9 display the status of the printing apparatus 1 and provide the user with a display for prompting operations by the operation key 8. The controller unit 13 causes the display panel 9 to display thumbnails that are created from print data input from a host 2. Thumbnails may be transferred to a host 2 to be displayed. The engine unit 14 feeds paper, prints print data generated by the controller 13, and discharges the sheet. If an abnormality such as a paper jam and a paper out occurs in the engine unit 14, the abnormality is notified to the controller unit 13. The controller unit 13 displays the occurrence of the abnormality on the display panel 9 and/or performs notification processing to a host 2.

Next, the internal configuration of the controller unit 13 will be described. The controller unit 13 includes a controller microcomputer 17, a system memory 18, an interface circuit (hereinafter, referred to as an I/F circuit) 19, a reception buffer 20, an image processing circuit 21, and a controller memory 22.

Next, an operation according to the block diagram of FIG. 2 will be described. Controls including analysis of a print job input from outside, image processing, and conversion processing into a bitmap are all governed by the controller microcomputer 17. The flow of print data is as follows: A print job input from a host 2 is stored into the reception buffer 20 through the I/F circuit 19. The I/F circuit 19 notifies the controller microcomputer 17 of the reception of the print job. A print job includes image data and various setting information such as sizes and types of paper. The controller microcomputer 17 analyzes the received print job and gives instructions to the image processing circuit 21 and the engine unit 14. The image data stored in the reception buffer 20 is performed image processing by the image processing unit 21 to become bitmap format. The resulting bitmap is stored into the controller memory 22 and then transmitted to the engine unit 14.

A thumbnail corresponding to the print data is obtained by reducing the bitmap stored in the controller memory 22 in size. The obtained thumbnail is stored into the system memory 18.

Content of operations on the operation keys 8 is input to the controller microcomputer 17. The controller microcomputer 17 performs appropriate processing according to the input content. The engine unit 14 notifies the controller microcomputer 17 of a printing status and the content of an error if any. The notification is displayed on the display panel 9 and/or notified to a host 2.

Figure 3A:
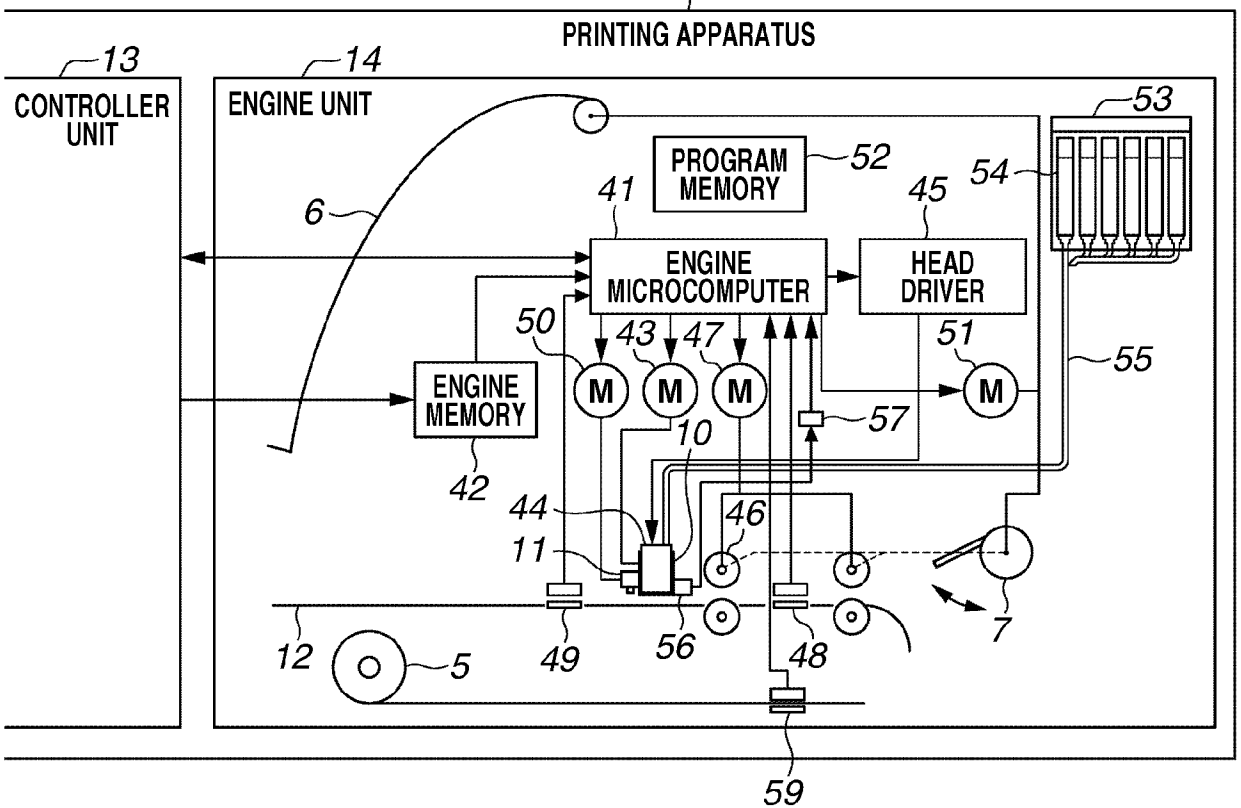
FIGS. 3A and 3B are diagrams illustrating an overview of the configuration of the printing apparatus according to the exemplary embodiment of the present invention.

FIG. 3A is a diagram illustrating the internal configuration of the engine unit 14. FIG. 3A illustrates the printing apparatus 1 as seen sideways. The printing apparatus 1 is illustrated with roll sheet 5 unfed, the main cover 6 open, and the release lever 7 released. In the diagram, the engine unit 14 includes an engine microcomputer 41, an engine memory 42, a carriage motor 43, a print head 44 for printing an image on continuous paper in an image forming unit, and a head driver 45. A roller 46 serves as a feeding unit or conveyance unit. A line feed (LF) motor 47 drives the roller 46. A sheet feed sensor 48 detects the presence or absence of continuous paper in a conveyance path on the upstream side of the image forming unit. A sheet discharge sensor 49 detects the presence or absence of continuous paper in the conveyance path on the downstream side of the image forming unit. A cutter motor 50 drives the cutter unit 11 serving as the cut unit. The engine unit 14 also includes a solenoid 51, a program memory 52, the ink tank cover 53, ink tanks 54, and ink tubes 55. In the present exemplary embodiment, the ink tanks 54 and the ink tubes 55 are provided for six colors. The engine unit 14 also includes a paper sensor 56 and a signal processing circuit 57. A load sensor 59 detects whether a roll sheet 5 is loaded.

When the main cover 6 is open and the release lever 7 is released as illustrated in FIG. 3A, the roller 46 and the carriage 10 are not driven. Since the release of the release lever 7 keeps the roller 46 away from the platen 12, continuous paper drawn out of the roll sheet 5 can be inserted over the platen 12. The main cover 6 and the release lever 7 are then closed to start sheet feeding and a print operation. The roll sheet 5 can also be fed without opening and closing the main cover 6 and the release lever 7. In such a case, the load sensor 59 detects a leading edge of the roll sheet 5 and starts a sheet feed control. Control of the sheet feed will be described later.

Figure 3B:
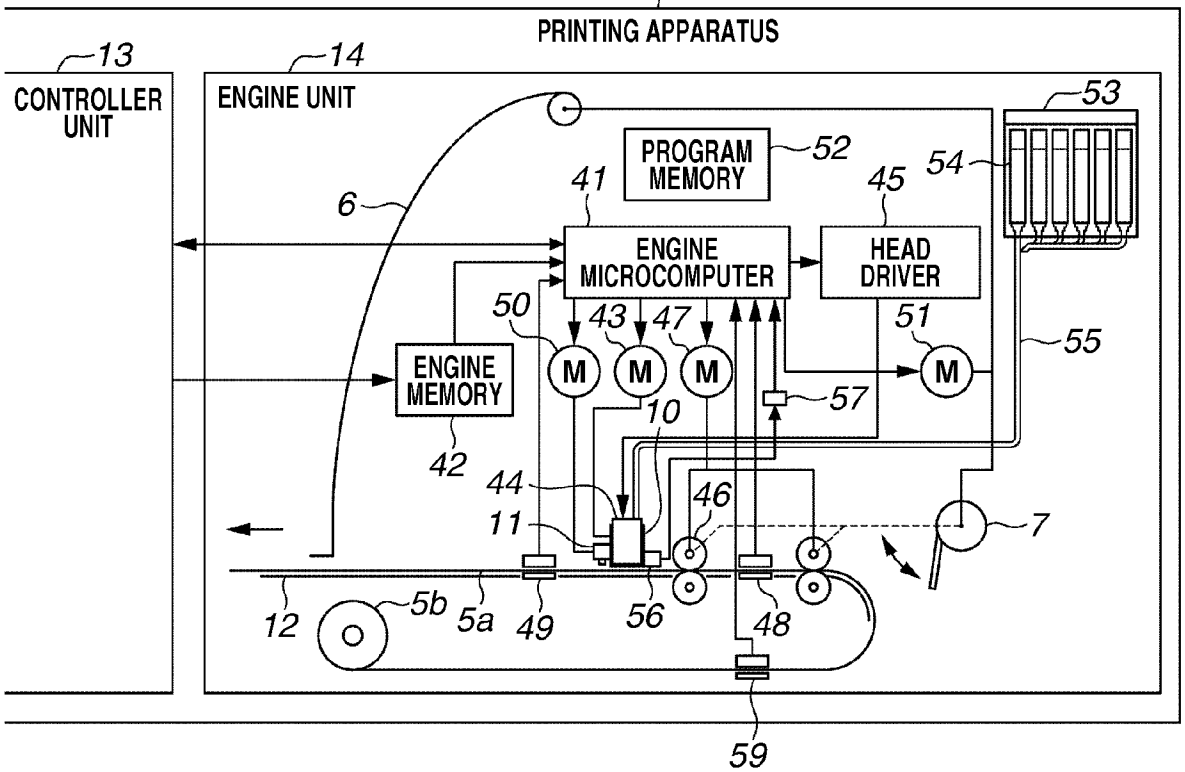

FIG. 3B illustrates a state where continuous paper 5*a* drawn out of the loaded roll sheet 5 by the roller 46 is fed and the main cover 6 and the release lever 7 are closed. Hereinafter, the portion drawn out of the roll of the roll sheet 5 may also be referred to as a sheet or continuous sheet 5*a*. The roll shape portion supported by the support unit may be referred to as a roll sheet 5*b*. An operation according to the block diagram of FIG. 3B will be described. Controls including feeding and discharging of the continuous paper 5*a* and control of the print head 44 are all governed by the engine microcomputer 41 serving as a control unit. A bitmap transmitted from the controller unit 13 is stored into the engine memory 42. The continuous paper 5*a* is fed and discharged by driving the LF motor 47 to rotate the roller 46 after the user inserts a leading edge of the continuous paper 5*a* drawn out of the roll sheet 5*b* into the sheet feeding section. The sheet feed sensor 48 and the sheet discharge sensor 49 detect the presence or absence of the continuous paper 5*a* to determine whether the sheet feeding and the sheet discharging is operated properly. The paper sensor 56 is arranged on the carriage 10. The paper sensor 56 detects the presence or absence, density, and skew of paper. While the carriage 10 reciprocates in directions perpendicular to the sheet surface and the conveyance direction of a print sheet, the paper sensor 56 continuously detects the presence or absence of paper to detect the width of the paper. The paper sensor 56 also continuously detects the density of the paper to detect a pattern printed on the paper. Signals detected by the paper sensor 56 are amplified by the signal processing circuit 57 and taken into the engine microcomputer 41. The signal processing circuit 57 changes the amplitude between when detecting the presence or absence of continuous paper 5*a* and when detecting density so that the signals are detected with high accuracy. The paper sensor 56 detects skew by determining whether the amount of deviation between the positions of a left end of continuous paper 5*a* at two points where the continuous paper 5*a* is drawn out by respective different amounts falls within a predetermined range.

The print head 44 is integrated with the carriage 10 and driven by the head driver 45. Six color inks are supplied to the print head 44 from the ink tanks 54 through the ink tubes 55. The carriage motor 43 causes the carriage 10 to reciprocate in the directions perpendicular to the sheet surface and the conveyance direction of the print sheet, and the print head 44 records an image on the continuous paper 5*a*. When the image formation is ended, the cutter unit 11 integrated with the carriage 10 descends by the cutter motor 50. The carriage 10 is then driven in a direction perpendicular to the sheet surface and the conveyance direction of the print sheet to cut the continuous paper 5*a*. During the feeding and printing of the continuous paper 5*a*, the solenoid 51 locks the main cover 6 and the release lever 7 in a closed state, so that the main cover 6 cannot be open and the release lever 7 cannot be released. If the sheet feed sensor 48 and the sheet discharge sensor 49 detect a jam of the continuous paper 5*a*, the engine unit 14 quits printing and notifies the controller unit 13 of the jam.

Figure 4:
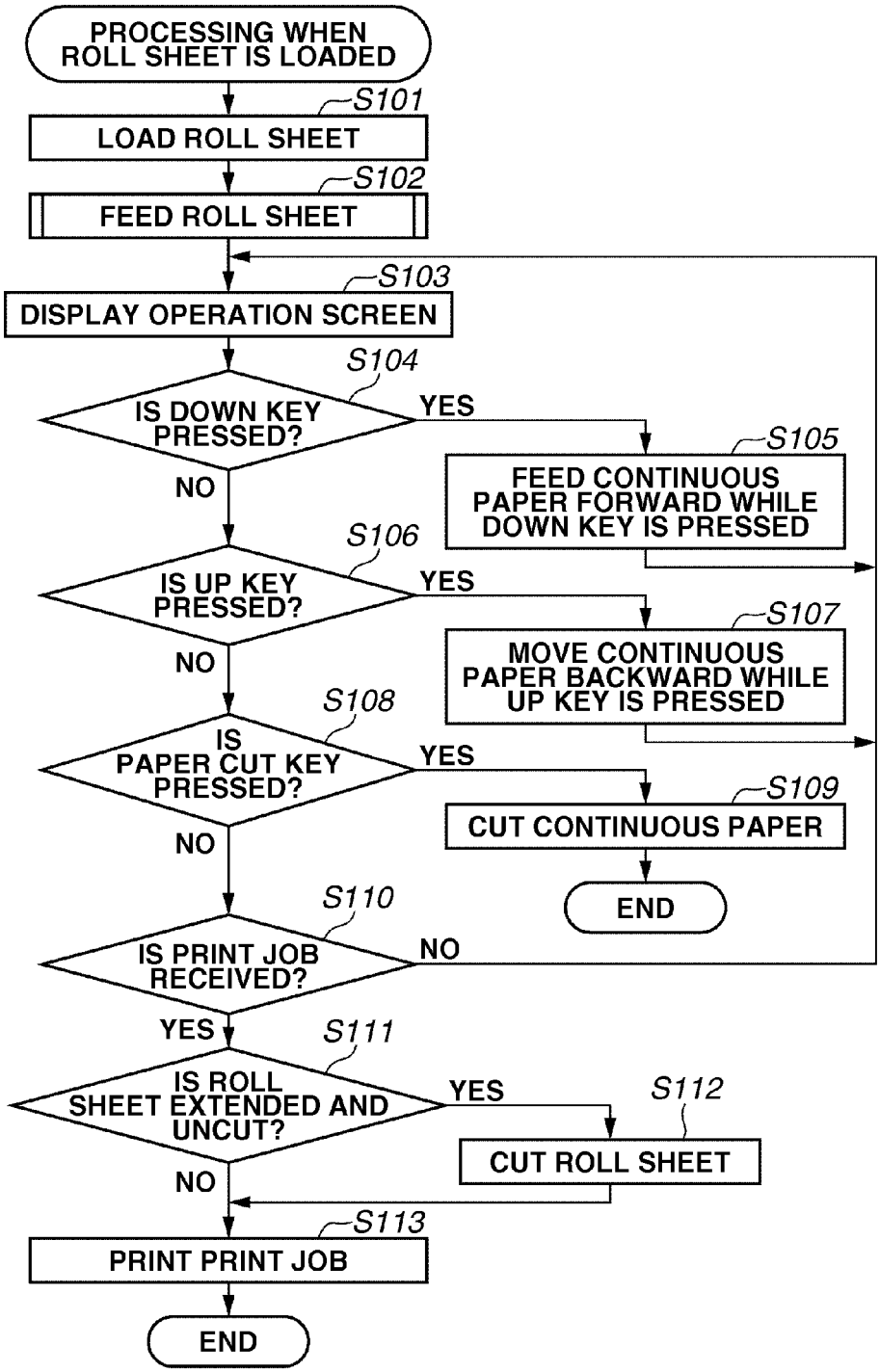
FIG. 4 is a flowchart illustrating an operation of a first exemplary embodiment.

FIG. 4 is a flowchart illustrating an operation of the first exemplary embodiment of the present invention. The flowchart is a program chart illustrating a program flow that is built in the system memory 18 of FIG. 2 and the program memory 52 of FIG. 3A or 3B and is processed by the controller microcomputer 17 and the engine microcomputer 41. The controller microcomputer 17 and the engine microcomputer 41 cooperate to perform control operations according to the program flow.

The flow of FIG. 4 describes processing after a roll sheet 5 is loaded into the printing apparatus 1. Hereinafter, the flow will be described along the steps of the flows.

Figure 11:
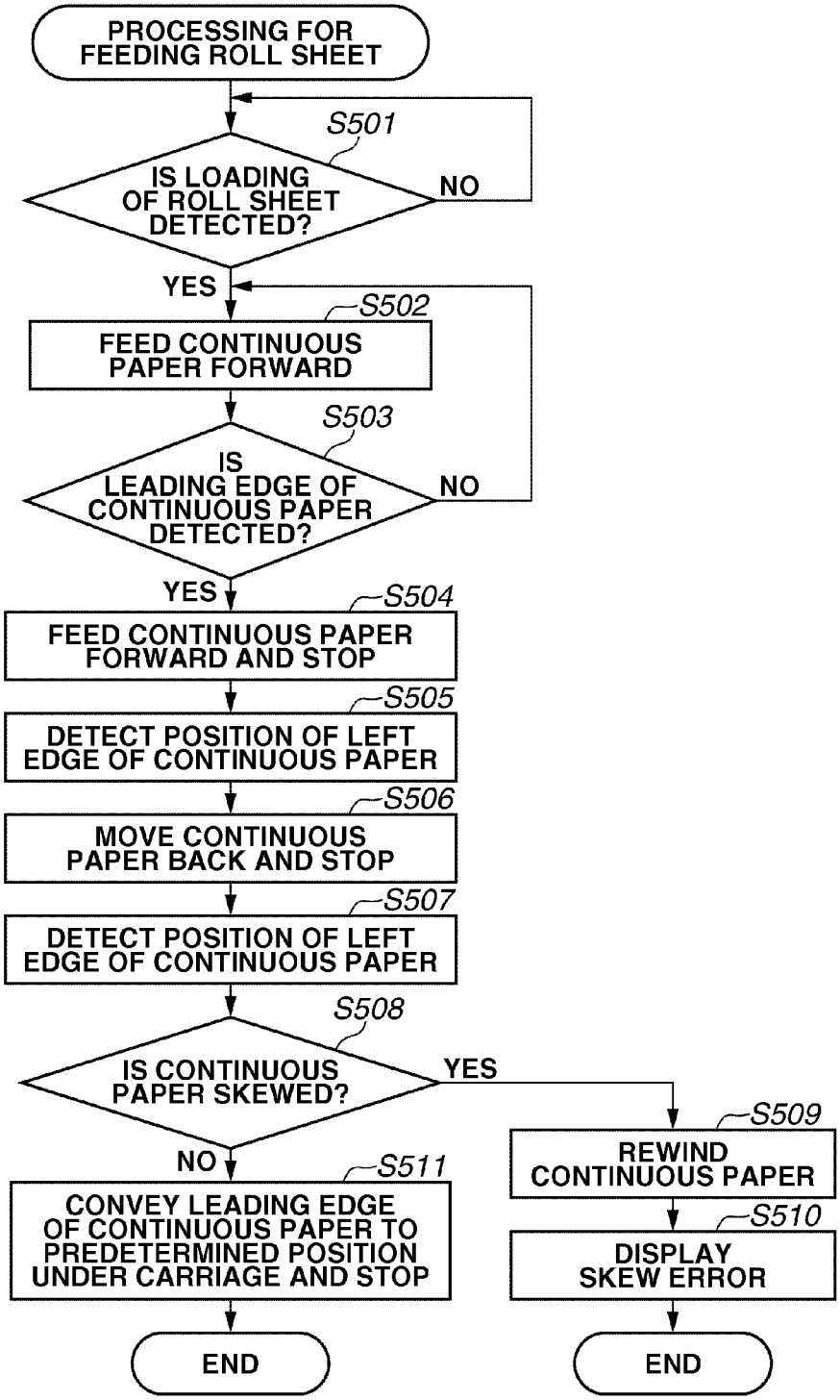
FIG. 11 is a flowchart illustrating an operation for feeding a roll sheet 5.

In step S101, the operator loads a roll sheet 5. In step S102, the printing apparatus 1 feeds the roll sheet 5. The processing for feeding a roll sheet 5 will be described in detail with reference to the flowchart of FIG. 11. In step S501, if the load sensor 59 detects loading of a roll sheet 5 (YES in step S501), then in step S502, the printing apparatus 1 feeds continuous paper 5*a* drawn out of the roll sheet 5*b* forward. For the forward feeding, the engine microcomputer 41 drives the LF motor 47 to rotate the roller 46 so that the continuous paper 5*a* is conveyed in a forward direction. In step S503, the engine microcomputer 41 feeds the continuous paper 5*a* until the paper sensor 56 detects the leading edge of the continuous paper 5*a*. If the leading edge is detected (YES in step S503), then in step S504, the engine microcomputer 41 further feeds the continuous paper 5*a* by a predetermined length and stops. In step S505, the engine microcomputer 41 uses the paper sensor 56 to detect the position of the left edge of the continuous paper 5*a* with respect to the extended direction of the continuous paper 5*a*. In step S506, the engine microcomputer 41 moves the continuous paper 5*a* back by a predetermined length and stops. In step S507, the engine microcomputer 41 detects the position of the left edge of the continuous paper 5*a* similarly to step S505. In step S508, the engine microcomputer 41 performs skew detection. The engine microcomputer 41 performs the skew detection based on the amount of deviation between the position of the left edge of the continuous paper 5*a* detected in step S505 and that of the left edge of the continuous paper 5*a* detected in step S507. If the amount of deviation exceeds a predetermined range, the engine microcomputer 41 regards the continuous paper 5*a* as being skewed (YES in step S508). Then in step S509, the engine unit 14 rewinds the continuous paper 5*a*. In step S510, the controller microcomputer 17 displays a skew error on the display panel 9, and ends the processing for feeding the continuous paper 5*a*. If the continuous paper 5*a* is not skewed (NO in step S508), then in step S511, the engine unit 14 conveys the leading edge of the continuous paper 5*a* to a predetermined position under the carriage 10 in the image forming unit and stops, and ends the processing for feeding the continuous paper 5*a*.

Figure 5:
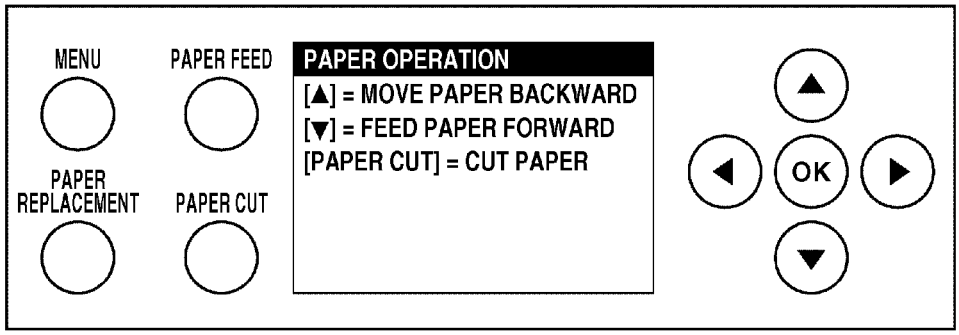
FIG. 5 is a diagram illustrating an operation screen of a display panel according to the first exemplary embodiment.

Returning to FIG. 4, after the feeding of the continuous paper 5*a* is completed, then in step S103, the printing apparatus 1 displays an operation screen illustrated in FIG. 5. The operation screen is displayed on the display panel 9. The operator can operate the operation keys 8 to activate the roller 46 and the cutter unit 11 before printing is first performed after the feeding processing. The operation keys 8 can be operated to perform any one of the following operations by using the roller 46 and the cutter unit 11: moving the continuous paper 5*a* backward; feeding the continuous paper 5*a* forward; and cutting the continuous paper 5*a*. In step S104, if the controller microcomputer 17 determines that a down key is pressed (YES in step S104), then in step S105, the engine unit 14 conveys the continuous paper 5*a* stopped at a predetermined position after the end of the feeding processing from the stopped position in a direction of extension from the roll sheet 5*b* (discharge direction) while the down key is pressed. In other words, the continuous paper 5*a* is conveyed as much as a conveyance amount corresponding to the duration (operation amount) of the down key continuing being pressed. The duration of the time that the down key continues being pressed may be arbitrarily determined by the operator. The continuous paper 5*a* can be conveyed by an arbitrary amount according to the continuous pressing duration. In step S106, if the controller microcomputer 17 determines that an up key is pressed (YES in step S106), then in step S107, the engine unit 14 conveys the continuous paper 5*a* in a direction (reverse direction) to rewind the continuous paper 5*a* to the roll sheet 5*b* while the up key is pressed. It should be noted that the engine microcomputer 41 stops the continuous paper 5*a* if the leading edge of the continuous paper 5*a* is conveyed up to the predetermined position at the end of the feeding processing. In such a manner, the up key and down key can be operated to locate a position of the continuous paper 5*a* to be cut (cut position) to the position of a blade of the cutter unit 11. In step S108, if the controller microcomputer 17 determines that a paper cut key is pressed (YES in step S108), then in step S109, the engine unit 14 cuts the continuous paper 5*a* with the cutter unit 11 and ends the processing of the flowchart. It should be noted that the continuous paper 5*a* will not be cut when not extended at all.

In step S110, if a print job is received from a host 2 while the operation screen of FIG. 5 is displayed (YES in step S110), the engine microcomputer 41 proceeds to step S111. If not (NO in step S110), the controller microcomputer 17 returns to step S103. In step S111, if the engine microcomputer 41 determines that the roll sheet 5 is extended and uncut (YES in step S111), then in step S112, the engine microcomputer 41 cuts the roll sheet 5 with the cuter unit 11. In step S113, the engine unit 14 prints the print job. Upon completion, the engine microcomputer 41 ends the processing of the present flow. The printing in step S113 is the first printing after the new roll sheet 5 is loaded. The foregoing steps S103 to S110 are performed between the loading of the new roll sheet 5 and the first printing after the loading.

In the present flow, when the operator loads a roll sheet 5 into the printing apparatus 1, the printing apparatus 1 feeds the roll sheet 5. After the completion of the sheet feeding, continuous paper 5*a* can be fed to an arbitrary position or cut. Consequently, the operator can feed the continuous paper 5*a* as much as unwanted for printing and cut before actual printing by checking a stain level at the leading edge of the continuous paper 5*a*. Unstained continuous paper 5*a* after being cut can thus be used for the first printing after the loading of the roll sheet 5. If the printing apparatus 1 receives a print job from a host 2 while the operation screen displayed in step S103 is displayed, the printing apparatus 1 exits from the display of the operation screen and print the print job. This prevents printing from becoming unavailable because the operation screen is displayed and left with the operation keys 8 not operated.

As described above, the first exemplary embodiment has dealt with the processing when a roll sheet 5 is loaded. The roll sheet 10 is conveyed to a desired position by operations on the operation keys 8 for advancing and retracting the roll sheet 10 and cut by an operation on the paper cut key between when the leading edge of the roll sheet 5 is automatically conveyed to the position of the carriage 10 and when a print job is received.

Figure 6:
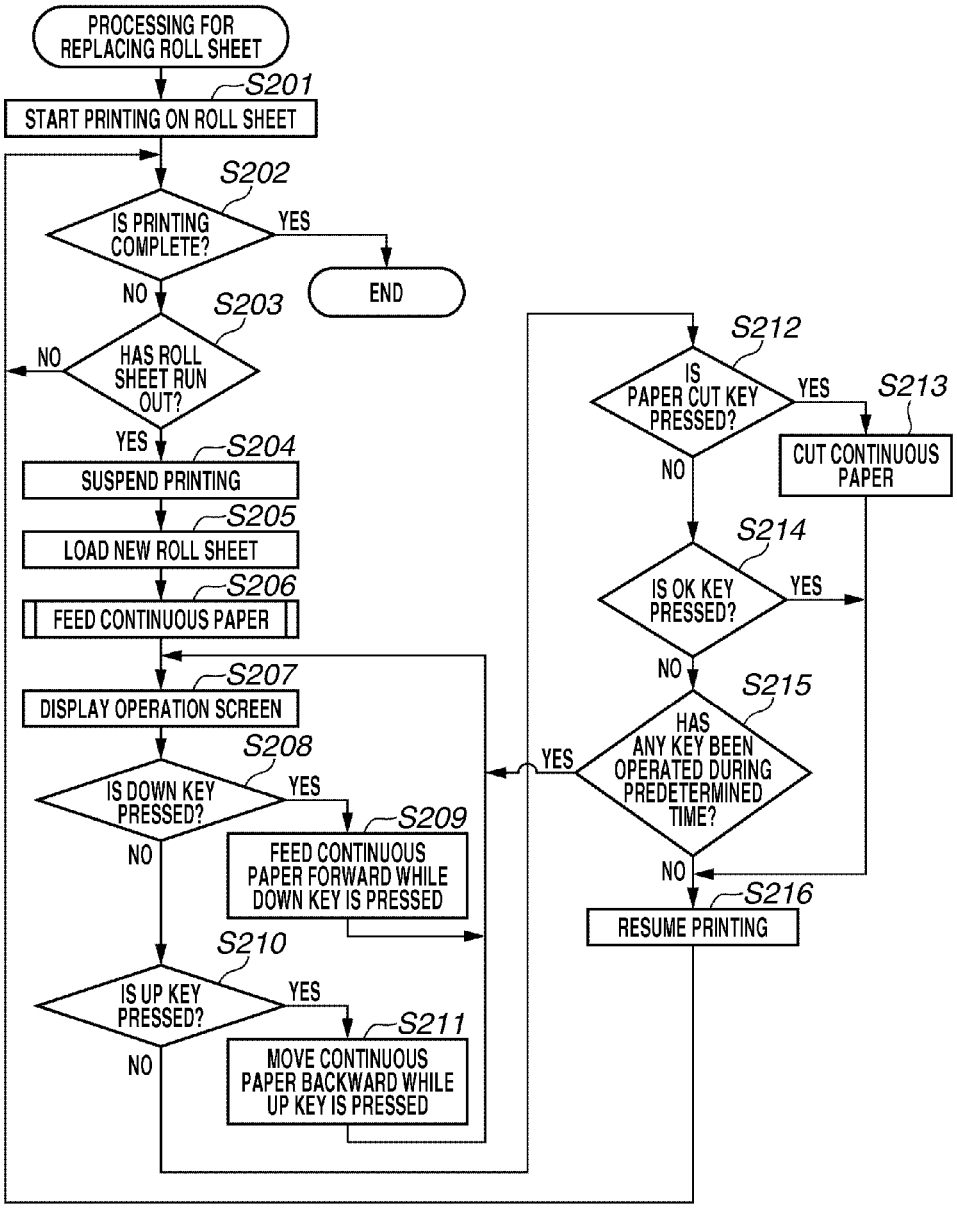
FIG. 6 is a flowchart illustrating an operation of a second exemplary embodiment.

A second exemplary embodiment will be described. FIG. 6 is a flowchart illustrating an operation of the second exemplary embodiment of the present invention. The flowchart is a program chart illustrating a program flow that is built in the system memory 18 of FIG. 2 and the program memory 52 of FIG. 3A or 3B and is processed by the controller microcomputer 17 and the engine microcomputer 41. The controller microcomputer 17 and the engine microcomputer 41 cooperate to perform control operations according to the program flow.

The flow of FIG. 6 describes processing when a roll sheet 5*b* runs out during printing of a print job on the continuous paper 5*a*, and is replaced with a new roll sheet 5. Hereinafter, the flow will be described along the steps of the flows.

Figure 7:
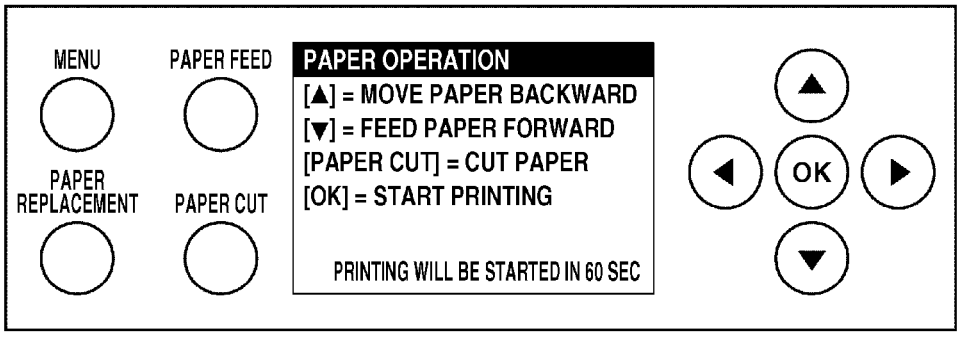
FIG. 7 is a diagram illustrating an operation screen of a display panel according to the second exemplary embodiment.

In step S201, the printing apparatus 1 starts printing a print job received from a host 2 on the continuous paper 5*a*. Suppose here that the roll sheet 5 has been loaded and fed before starting printing. In step S202, if the printing is completed (YES in step S202), the printing apparatus 1 ends the processing of the present flow. If the printing is not complemented (NO in step S202) and the roll sheet 5 runs out in step S203 (YES in step S203), then in step S204, the printing apparatus 1 suspends printing. The printing is suspended until step S216. If a new print job is received, printing of that new print job is also suspended. In step S205, the operator loads a new roll sheet 5 into the printing apparatus 1. In step S206, the printing apparatus 1 feeds continuous paper 5*a*. The processing for feeding the continuous paper 5*a* is the same as that of the flow of FIG. 11 according to the first exemplary embodiment. After the completion of the feeding of the continuous paper 5*a*, then in step S207, the printing apparatus 1 displays an operation screen illustrated in FIG. 7. The operation screen is displayed on the display panel 9. The operator can operate the operation keys 8 to perform either one of the operations of FIG. 5 according to the first exemplary embodiment in addition to an operation of immediately starting printing. The operation screen of FIG. 7 also displays the time to start printing. Detailed description will be given later. In step S208, if the controller microcomputer 17 determines that the down key is pressed (YES in step S208), then in step S209, the printing apparatus 1 conveys the continuous paper 5*a* in an extending direction while the down key is pressed. In step S210, if the controller microcomputer 17 determines that the up key is pressed (YES in step S210), then in step S211, the printing apparatus 1 conveys the continuous paper 5*a* in a retracting direction while the up key is pressed. Note that the continuous paper 5*a* is stopped if the leading edge of the continuous paper 5*a* is conveyed up to a predetermined position. In step S212, if the controller microcomputer 17 determines that the paper cut key is pressed (YES in step S212), then in step S213, the engine unit 14 cuts the continuous paper 5*a* with the cutter unit 11. The controller microcomputer 17 then proceeds to step S216. Note that the continuous paper 5*a* will not be cut if not extended. In step S214, if the controller microcomputer 17 determines that an OK key is pressed (YES in step S214), the controller microcomputer 17 proceeds to step S216. In step S215, if none of the operation keys 8 has been operated during a predetermine time (NO in step S215), then the controller microcomputer 17 proceeds to step S216. Otherwise (YES in step S215), the controller microcomputer 17 returns to step S207 with the printing suspended. The controller microcomputer 17 measures the duration of the state where the printing is suspended. If the controller microcomputer 17 determines in step S215 that a predetermined time has elapsed (YES in step S215), then in step S216, the controller microcomputer 17 releases the suspension of the printing to resume printing. The controller microcomputer 17 returns to step S202, and if the printing is completed (YES in step S202), ends the processing of the present flow.

In the present flow, when the continuous paper 5*a* runs out during printing, the printing is suspended and the continuous paper 5*a* is replaced with a new roll sheet 5 and fed. The printing will not be resumed immediately after the completion of the sheet feeding. Instead, the printing is suspended so that the continuous paper 5*a* can be fed up to an arbitrary position or cut. This can avoid printing on a stained leading edge of the continuous paper 5*a*. The operator can check a stain level at the leading edge of the continuous paper 5*a*, and feed as much as unwanted for printing and cut the continuous paper 5*a*. The printing can thus be resumed on unstained continuous paper 5*a* after being cut. If the continuous paper 5*a* is not stained, the operator can press the OK key to immediately resume printing. If none of the operation keys 8 has been operated during a predetermined time with the operation screen displayed in step S207 kept displayed, the printing apparatus 1 resumes printing by a suspension release unit releasing the suspension of the printing. This prevents printing from becoming unavailable because the operation screen is displayed and left with the operation keys 8 not operated. The time to start printing is displayed on the operation screen to inform the operator in what time printing will be resumed if none of the operation keys 8 is operated.

The second exemplary embodiment has dealt with the processing when a roll sheet 5 runs out during printing and is replaced with a new roll sheet 5. Between the feeding of the newly loaded roll sheet 5 and a lapse of a predetermined time, the operation keys 8 for advancing and retracting the roll sheet 5 can be operated to convey the roll sheet 5 to a desired position. The paper cut key can be operated to cut the roll sheet 5.

Figure 8:
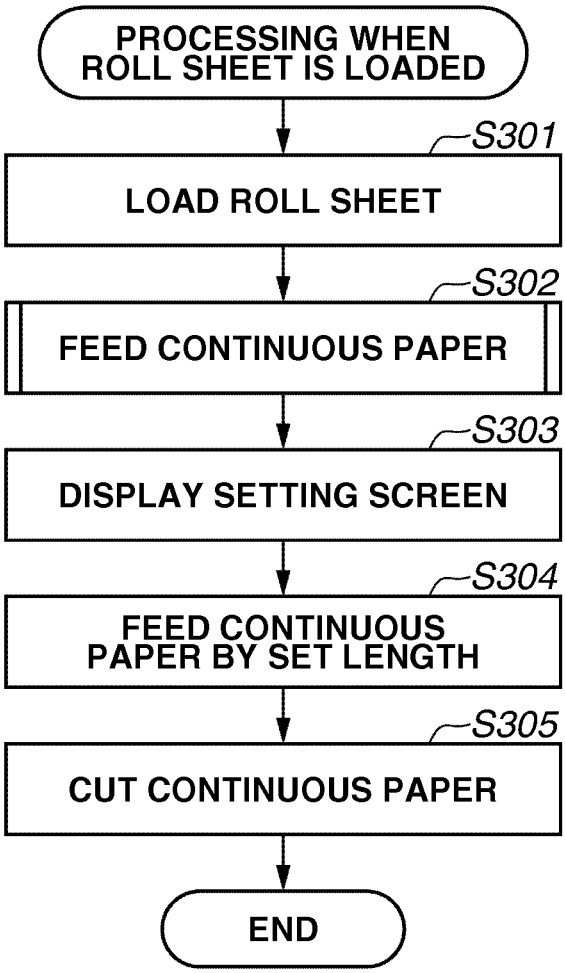
FIG. 8 is a flowchart illustrating an operation of a third exemplary embodiment.

A third exemplary embodiment will be described. FIG. 8 is a flowchart illustrating an operation of the third exemplary embodiment of the present invention. The flowchart is a program chart illustrating a program flow that is built in the system memory 18 of FIG. 2 and the program memory 52 of FIG. 3A or 3B and is processed by the controller microcomputer 17 and the engine microcomputer 41. The controller microcomputer 17 and the engine microcomputer 41 cooperate to perform control operations according to the program flow.

The flow of FIG. 8 describes processing when a roll sheet 5 is loaded into the printing apparatus 1. FIG. 8 illustrates an example where the length to feed and cut continuous paper 5*a* after the completion of the sheet feeding is set during the processing of feeding the continuous paper 5. Hereinafter, the flow will be described along the steps of the flows.

Figure 9:
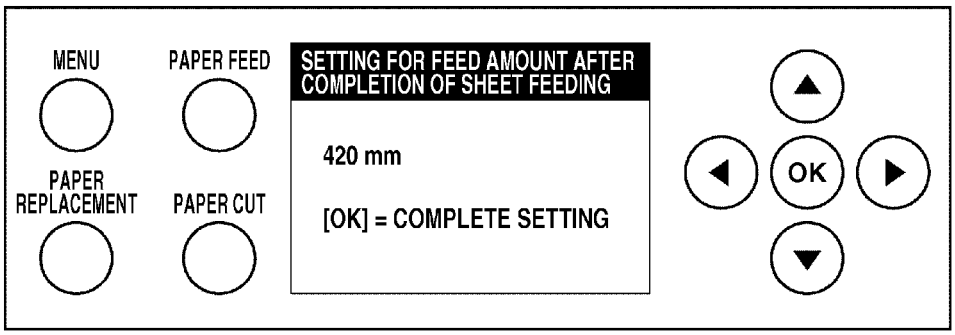
FIG. 9 is a diagram illustrating a setting screen of a display panel according to the third exemplary embodiment.

In step S301, the operator loads a roll sheet 5. In step S302, the printing apparatus 1 feeds continuous paper 5*a*. The processing for feeding the continuous paper 5*a* is the same as that of the flow in FIG. 11 according to the first exemplary embodiment. The printing apparatus 1 conveys the continuous paper 5*a* until the leading edge of the continuous paper 5*a* reaches a predetermined position under the carriage 10 in the image forming unit. In step S303, during the processing of feeding the continuous paper 5*a*, the controller microcomputer 17 causes the display panel 9 to provide a display for prompting input of a conveyance distance. The operator operates the operation keys 8 serving as an input unit, to input the length for the continuous paper 5*a* to be automatically conveyed in the extending direction after the completion of the sheet feeding. The content set by the input is displayed on the display panel 9. FIG. 9 illustrates a setting example where the continuous paper 5*a* is to be conveyed by 420 mm in the extending direction after the completion of sheet feeding. A left key and a right key are used to shift digits. The up key and down key are used to change numbers. The operator presses the OK key to complete the setting, followed by the completion of the sheet feeding. In step S304, the printing apparatus 1 conveys the continuous paper 5*a* in the extending direction as much as the length set by the setting screen of FIG. 9. In step S305, the printing apparatus 1 cuts the continuous paper 5*a* and ends the processing of the present flow.

In the present flow, the length to feed and cut continuous paper 5*a* after the completion of sheet feeding is set during the feeding of the continuous paper 5*a*. If the length of the continuous paper 5*a* unwanted for printing is known, the continuous paper 5*a* can be fed and cut by an easier operation of setting the length than by pressing the up key, down key, and paper cut key described in the first and second exemplary embodiments.

Figure 10:
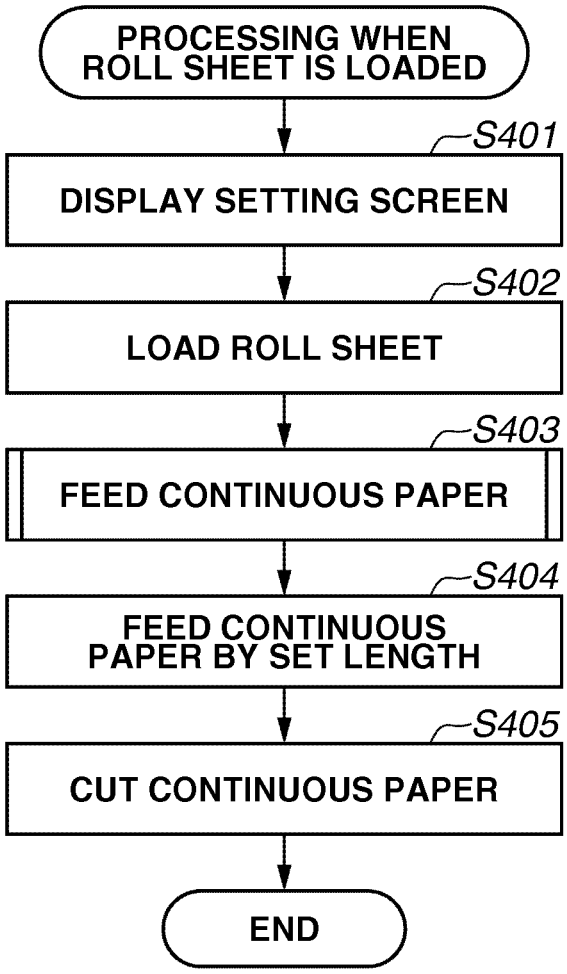
FIG. 10 is a flowchart illustrating an operation of a fourth exemplary embodiment.

A fourth exemplary embodiment will be described. FIG. 10 is a flowchart illustrating an operation of the fourth exemplary embodiment of the present invention. The flowchart is a program chart illustrating a program flow that is built in the system memory 18 of FIG. 2 and the program memory 52 of FIG. 3A or 3B and is processed by the controller microcomputer 17 and the engine microcomputer 41. The controller microcomputer 17 and the engine microcomputer 41 cooperate to perform control operations according to the program flow.

The flow of FIG. 10 illustrates an example where the length to feed and cut continuous paper 5*a* after the completion of sheet feeding is set in advance before a roll sheet 5*a* is loaded into the printing apparatus 1. Hereinafter, the flow will be described along the steps of the flows.

In step S401, before loading a roll sheet 5, the operator sets the length for continuous paper 5*a* to be automatically conveyed in the extending direction after the completion of paper feeding, by the setting screen of FIG. 9 in advance. The setting screen appears when the operator presses a menu key and selects from a displayed menu. In step S402, the operator loads a roll sheet 5. In step S403, the printing apparatus 1 feeds continuous paper 5*a*. The processing for feeding the continuous paper 5*a* is the same as that of the flow of FIG. 11 according to the first exemplary embodiment. In step S404, after the completion of the sheet feeding, the printing apparatus 1 conveys the continuous paper 5*a* in the extending direction as much as the length set from the setting screen of FIG. 9. In step S405, the printing apparatus 1 cuts the continuous paper 5*a* and ends the processing of the present flow.

In the present flow, the length to feed and cut continuous paper 5*a* after the completion of sheet feeding is set in advance before the continuous paper 5*a* is loaded. Whereas the sheet feeding operation of step S403 takes some time, the operator can leave the printing apparatus 1 and do other work once the roll sheet 5 is loaded. A highly usable printing apparatus can thus be provided.

According to the foregoing exemplary embodiments, the operator can determine whether to cut a leading edge of a roll sheet when loading a roll sheet into the printing apparatus. If the roll sheet is to be cut, the length of the roll sheet to be cut can be freely specified by operator's operation. Consequently, a roll sheet can be handled in an optimal way according to a stain level of the leading edge of the roll sheet. A reduction in print quality can also be avoided.

While the present invention has been described with reference to exemplary embodiments, it is to be understood that the invention is not limited to the disclosed exemplary embodiments. The scope of the following claims is to be accorded the broadest interpretation so as to encompass all modifications, equivalent structures, and functions.

This application claims priority from Japanese Patent Application No. 2011-160911 filed Jul. 22, 2011, which is hereby incorporated by reference herein in its entirety.

What is claimed is:

1. A printing apparatus comprising:

a support unit configured to support a continuous sheet;

an operation unit configured to operate a conveyance unit to convey the continuous sheet in accordance with an operator's instruction;

a detection unit configured to detect that a continuous sheet has been loaded into the support unit;

a cut unit configured to cut the continuous sheet drawn from the support unit; and a display control unit configured to cause a display unit to display an operation screen for prompting operations by the operation unit, wherein in response to the detection by the detection unit that a continuous sheet has been loaded into the support unit, the display control unit causes the display unit to display the operation screen for prompting operations by the operation unit to selectively advance or reverse the continuous sheet before cutting the continuous sheet by the cut unit and before a printing on the continuous sheet is started.

2. The printing apparatus according to claim 1, further comprising:

a reception unit configured to receive a print job; and a printing unit configured to print the received print job, and wherein the printing unit is configured to start printing the received print job, if the cut unit cuts the continuous sheet drawn from the support unit.

3. The printing apparatus according to claim 2, wherein if the cut unit does not cut the continuous sheet during a predetermined time since the continuous sheet has drawn out, the printing unit prints the received print job.

4. The printing apparatus according to claim 1, further comprising:

a reception unit configured to receive a print job; and a printing unit configured to print the received print job, wherein if the operation unit operates the conveyance unit in accordance with the operator's instruction, the printing unit does not print the received print job before the cut unit cuts the continuous sheet drawn from the support unit.

5. The printing apparatus according to claim 1, wherein the continuous sheet is cut, if the operator presses a paper cut key to cut the continuous sheet at the cut position after conveying the continuous sheet in accordance with the operator's instruction.

6. The printing apparatus according to claim 1, wherein the operation unit is configured to be capable of operating the conveyance unit so as to convey the continuous sheet to either advance or reverse for an arbitrary time.

7. The printing apparatus according to claim 1, wherein the conveyance unit is configured to convey a leading edge of the continuous sheet drawn from the support unit to a predetermined position, and wherein the operation unit is configured to operate the conveyance unit to convey the continuous sheet from the predetermined position by an arbitrary conveyance amount.

8. The printing apparatus according to claim 1, wherein the continuous sheet is a roll sheet.

9. The printing apparatus according to claim 1, wherein if the operation unit operates the conveyance unit in accordance with the operator's instruction, the cut unit automatically cuts the continuous sheet drawn from the support unit without any further instruction from an operator.

10. The printing apparatus according to claim 1, wherein the operation unit operates at least one of the conveyance unit and the cut unit in accordance with the operator's instruction.

11. The printing apparatus according to claim 1, wherein the operation screen includes a time to start printing.

12. The printing apparatus according to claim 1, wherein after the continuous sheet being loaded into the support unit, the conveyance unit conveys a leading edge of the continuous sheet drawn from the support unit to a predetermined position, and then the operation unit causes the display unit to display the operation screen.

13. A printing apparatus comprising:

a support unit configured to support a continuous sheet;

an operation unit configured to operate a conveyance unit to convey the continuous sheet in accordance with an operator's instruction;

a detection unit configured to detect that of a continuous sheet has been loaded into the support unit;

a cut unit configured to cut the continuous sheet drawn from the support unit; and a display control unit configured to cause a display unit to display an operation screen for prompting operations by the operation unit, wherein in response to the detection by the detection unit that a continuous sheet has been loaded into the support unit, the display control unit causes the display unit to display, before cutting and printing the continuous sheet, the operation screen for prompting operations by the operation unit to input a conveyance distance for the sheet to be drawn from the support unit.

14. A printing apparatus comprising:

a support unit configured to support a continuous sheet;

an operation unit configured to operate a conveyance unit to convey the continuous sheet in accordance with an operator's instruction;

a detection unit configured to detect that a continuous sheet has been loaded into the support unit;

a cut unit configured to cut the continuous sheet drawn from the support unit; and a display control unit configured to cause a display unit to display an operation screen for prompting operations by the operation unit, wherein in response to the detection by the detection unit that a continuous sheet has been loaded into the support unit, the display control unit causes the display unit to display the operation screen for prompting operations by the operation unit to advance the continuous sheet by a conveyance amount, which is specified by the operator, before cutting the continuous sheet by the cut unit and before a printing on the continuous sheet is started, wherein the operation unit is configured to have the conveyance amount input, and wherein the conveyance unit is configured to perform conveyance from a predetermined position by the input conveyance amount.

15. A method of cutting a continuous sheet comprising:

detecting that a continuous sheet has been loaded into the support unit;

displaying an operation screen for prompting operations by the operation unit to selectively advance or reverse a continuous sheet before cutting the continuous sheet by a cut unit and before any printing on the continuous sheet is started in response to the detection that a continuous sheet has been loaded into a support unit;

conveying the continuous sheet by using the operation screen in accordance with the operator's instruction; and cutting the continuous sheet drawn from the support unit with a cut unit.

* * * * *